US007117935B2

(12) United States Patent
Wanni et al.

(10) Patent No.: US 7,117,935 B2
(45) Date of Patent: Oct. 10, 2006

(54) SUPPORT SYSTEM FOR TUBE BUNDLE DEVICES

(75) Inventors: Amar S. Wanni, Falls Church, VA (US); Thomas M. Rudy, Warrenton, VA (US); Marciano M. Calanog, Stafford, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 27 days.

(21) Appl. No.: 10/963,041

(22) Filed: Oct. 12, 2004

(65) Prior Publication Data

US 2006/0162913 A1 Jul. 27, 2006

(51) Int. Cl.
*F28F 9/013* (2006.01)

(52) U.S. Cl. ..... 165/162; 165/DIG. 406

(58) Field of Classification Search ..... 165/162
See application file for complete search history.

(56) References Cited

U.S. PATENT DOCUMENTS

| | | | | |
|---|---|---|---|---|
| 1,777,356 | A * | 10/1930 | Fisher | 165/160 |
| 1,929,376 | A * | 10/1933 | Trainer et al. | 165/145 |
| 2,749,600 | A * | 6/1956 | Persson | 29/890.045 |
| 3,181,606 | A * | 5/1965 | Belanger | 165/158 |
| 3,249,154 | A * | 5/1966 | Legrand | 165/164 |
| 3,326,282 | A * | 6/1967 | Jenssen | 165/172 |
| 3,603,383 | A * | 9/1971 | Michael et al. | 165/158 |
| 4,386,456 | A | 6/1983 | Volz | |
| 4,398,567 | A * | 8/1983 | Moll | 138/113 |
| 4,450,904 | A * | 5/1984 | Volz | 165/162 |
| 5,251,693 | A * | 10/1993 | Zifferer | 165/160 |
| 2003/0178187 | A1 * | 9/2003 | Wanni et al. | 165/162 |

FOREIGN PATENT DOCUMENTS

| | | |
|---|---|---|
| DE | 948 691 C | 9/1958 |
| DE | 26 17 242 A1 | 11/1977 |
| EP | 1347258 | 9/2003 |
| EP | 1347261 | 9/2003 |
| EP | 1357344 | 10/2003 |
| GB | 607 717 A | 9/1948 |

OTHER PUBLICATIONS

International Search Report for PCT/US2005/034808.
Written Opinion for PCT/US2005/034808.

* cited by examiner

*Primary Examiner*—Allen J. Flanigan
(74) *Attorney, Agent, or Firm*—Glenn T. Barrett

(57) ABSTRACT

A tube bundle device such as a heat exchanger or condenser which has parallel tubes in a triangular configuration in which tubes are adjacent and spaced from six surrounding tubes. The tubes in the tube bundle have wire spacer/support elements comprising helically wound material which surrounds at least a portion of the length of each of the tubes; each tube with a spacer/support coil being in contact only with tubes which do not have a spacer/support coil and each tube without a spacer/support coil is in contact only with tubes which have a spacer/support coil.

11 Claims, 2 Drawing Sheets

SUPPORT SYSTEM FOR TUBE BUNDLE DEVICES

FIELD OF THE INVENTION

The present invention relates to tube bundle devices such as heat exchangers, condensers, or other collection of tubes, for example, in devices such as nuclear reactor cores, electrical heaters, or any collection of parallel cylindrical shapes that has a fluid flow passing over them, and more particularly to support structures for heat exchanger tubes within heat exchanger devices.

CROSS REFERENCE TO RELATED APPLICATIONS

Our co-pending U.S. patent application Ser. No. 10/209,126, filed 31 Jul. 2002, entitled Heat Exchanger Flow-Through Tube Supports (Publication No. 20030178187A1, corresponding to EP 1347258) describes a heat exchanger construction with coiled tube supports.

BACKGROUND OF THE INVENTION

Heat exchangers were developed many decades ago and they continue to be extremely useful in many applications requiring heat transfer. While many improvements to the basic design have been made, there still exist tradeoffs and design problems associated with the inclusion of heat exchangers within commercial processes.

One of the problems associated with the use of heat exchangers is the tendency toward fouling. Fouling refers to the formation of various deposits and coatings on the surfaces of heat exchangers as a result of process fluid flow and heat transfer. There are various types of fouling including corrosion, mineral deposits, polymerization, crystallization, coking, sedimentation and biological. In the case of corrosion, the surfaces of the heat exchanger can become corroded as a result of the interaction between the process fluids and the materials used in the construction of the heat exchanger. The situation is made even worse due to the fact that various fouling types can interact with each other to cause even more fouling. Fouling can and does result in additional resistance with respect to the heat transfer and thus decreased heat transfer performance. Fouling may also cause an increased pressure drop in connection with the fluid flowing on the inside of the exchanger.

One type of heat exchanger which is commonly used in commercial equipment is the shell-and-tube exchanger in which one fluid flows on the inside of the tubes, while the other fluid is forced through the shell and over the outside of the tubes. Typically, baffles are placed to support the tubes and to force the fluid across the tube bundle in a desirable manner.

Fouling can be decreased by the use of higher fluid velocities. In fact, one study has shown that a reduction in fouling in excess of 50% can result from a doubling of fluid velocity. While the use of higher fluid velocities can substantially decrease or even eliminate the fouling problem, higher fluid velocities are unfortunately, generally unattainable on the shell side of conventional shell-and-tube heat exchangers because of excessive pressure drops which are created within the system by baffles. Another problem that often arises in connection with the use of heat exchangers is tube vibration damage. Tube vibration is most intense and damage is most likely to occur in cross flow implementations where fluid flow is perpendicular to the tubes, although tube vibration damage can also occur in non-crossflow (i.e. axial) implementations with high fluid velocities.

Many heat exchangers in use today contain baffles. Baffles are interposed in the fluid path in order to provide support for the tubes and to ensure that the fluid on the outside the tubes flows in the desired direction with respect to the tubes. Unfortunately, however, baffles may increase fouling because of the dead zones they create on the shell side of the exchanger where flow is minimal or even non-existent. A further problem encountered in heat exchangers fitted with baffles is that cross flow may result in potential damage to the tubes as a result of flow-induced vibration. In the case of such damage, processes must often be interrupted or shut down in order to repair the device.

Different types of baffles are conventionally used. One type, segmental baffles, is unacceptable for the low-fouling heat exchangers described in our co-pending application because they produce many zones either with low velocity flow or even no flow at all increasing the probability of fouling. Other types (multiple styles including rods, strips, twisted-tubes) may create longitudinal flow in the central area of the exchanger but these technologies lack the inherent strength and flexibility of configuration of the coiled tube supports shown in application Ser. No. 10/209,126 to allow high velocities on the shellside of the exchanger. The present invention is a development of the coiled tube support system which is directly applicable to the triangular tube configuration and which, moreover, allows the design of more compact and less expensive exchangers.

The tube support system with coiled tube supports, described in application Ser. No. 10/209,126, is mostly suitable for the inline tube arrangement although, as described in the application, it may also be used with the triangular tube configuration. In application Ser. No. 10/209,126, the support structure uses spacer coils, which surround each tube in the bundle. For example, with the triangular tube configuration, the coils surround all the tubes in the bundle with coils on adjacent tubes being wrapped in opposite directions (clockwise and counterclockwise) so that they overlap in the inter-tube region and can be welded together to form an integrated, unitary structure.

The shell-and-tube heat exchanger of the present invention employs helically coiled wires to form a spacing and support structure for the tubes arranged in the triangular configuration within the heat exchanger shell. The wire of the coil, which is wound around alternate tubes in the bundle, has a radial thickness (diameter for a circular wire) substantially equal to the space between the heat exchanger tubes. The exchanger, in addition to the coil-encased tubes preferably uses sealing devices of particular configurations to achieve the desired flow patterns. With exchangers of this construction, the potential for dead zones is reduced and the high velocity axial flow that results substantially eliminates fouling problems, and significantly reduces flow-induced tube vibration that can lead to tube damage.

This invention provides easier fabrication as well as a robust design that is needed to operate the shellside at high velocities. This design must use the triangular tube layout. This tube layout is most suitable as it provides the maximum tubecount within a given shell diameter. This exchanger can be provided with a larger number of tie rods than necessary to achieve mechanical integrity of the bundle, which also provides flexibility in achieving the desired shellside velocity by minimizing flow bypassing.

DRAWINGS

DETAILED DESCRIPTION

Figure 1:
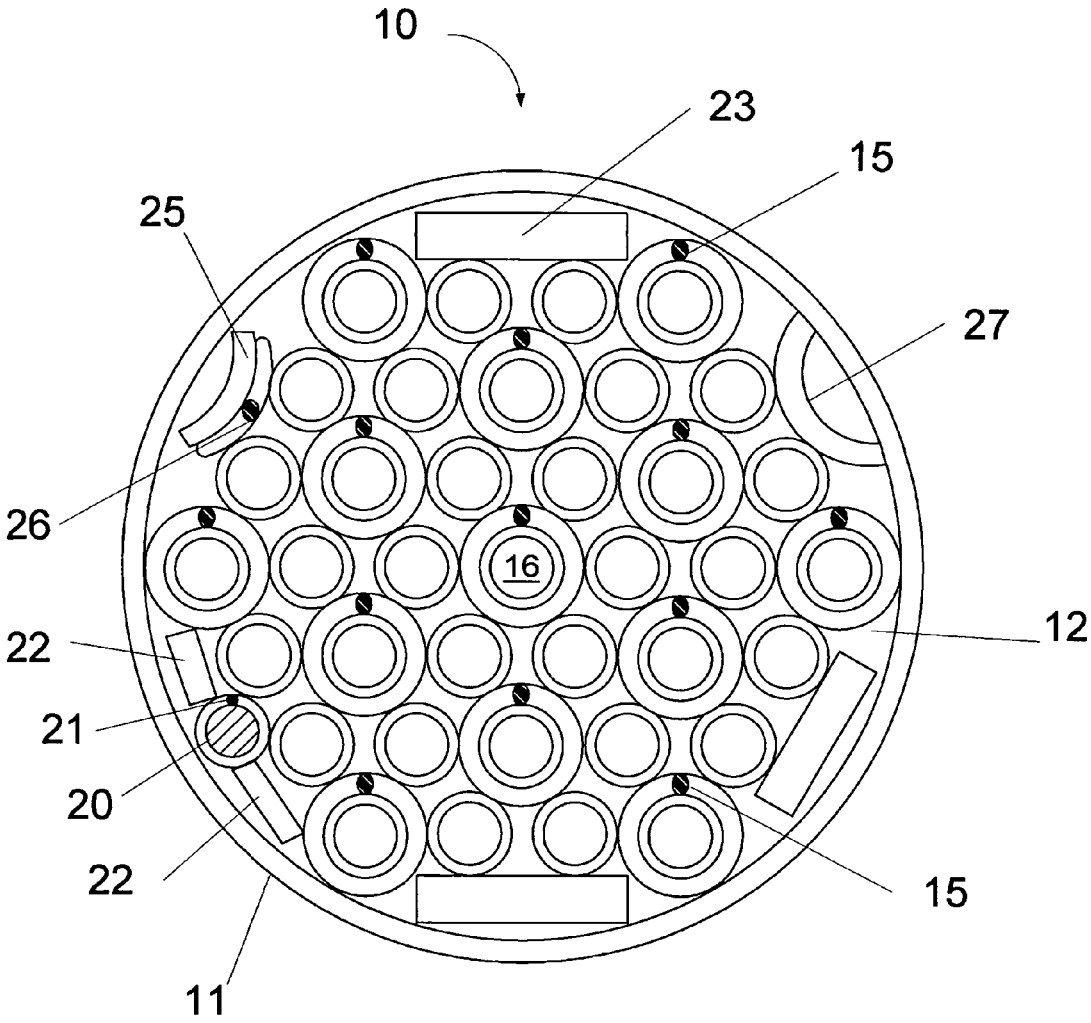
FIG. 1 is a simplified cross-section of a hypothetical heat exchanger incorporating the coil-encased tubes together with sealing devices and tie rod configurations.

In FIG. 1 the shell portion of a heat exchanger is shown to illustrate the tube bundle construction. While FIG. 1 shows a shell-and-tube exchanger in the form of the preferred single-pass form, the invention is applicable in principle to other forms of shell-and-tube exchangers such as, for example, two or more tube passes, U-shaped tubes, removable tube bundle designs, and exchangers known as multi-tube double pipes although more complicated arrangements may be required to fill in the additional void spaces in these other configurations.

The heat exchanger 10 of FIG. 1 includes a shell 11 and a tube bundle 12 in the shell. Tube bundle 12 includes a number of parallel tubes in the triangular configuration. The tubes are held in tubesheets (not shown) located at each end of the tube bundle in the conventional manner, being fastened to apertures within the tubesheets by welding and/or by expanding the tubes into the tubesheets. Alternate tubes are provided with spacing and support coils 15, which encircle the tubes in the bundle. The coils are helically wound on the selected tubes in the same manner as described and shown in U.S. patent application Ser. No. 10/209,126, to which reference is made for a description of the complete and partial tube coil supports. In the present system, however, the coils are applied only to the selected alternate tubes although, as described below, the coils may be applied to the entire length of the tubes or to only part of it.

With the tubes arranged in a triangular manner, the centermost tube 16 is provided with a coil surrounding it for all or a part of its length. The radial thickness of the coil material closely approximates the space between two adjacent tubes. The radial thickness is determined radially with respect to the tube around which it is wound; this will of course, be the diameter of the usual circular wire. The wire of the coils need not, however, be of circular cross-section; it may have various alternative cross-sections such as square, elliptical, rectangular, polygonal or other suitable geometric shapes and so may also be considered to be a wire even though in rod, strip, tube or bar form. In such cases, the radial thickness is to be taken as the transverse dimension of the coil, perpendicular to its length. The coils may be hollow if desired. The wire material for the coils is preferably comprised of erosion/corrosion-resistant material such as stainless steel, titanium or other materials with similar metallurgical characteristics.

Each coil should have two or more complete turns around the tube and be secured to the tube (e.g., or welding or an equivalent process, which preferably does not create or leave any sharp edges, which would tend to create). Similar coils are attached to the other tubes in the formation in a similar manner. The coils are placed on alternate tubes in the bundle; as shown in FIG. 1 this provides the desired tube spacing and because the coils provide mutual bracing and support to the tubes by their contact with the outer surfaces of the tubes, the coils are capable of reducing tube vibration. The reference to alternate tubes in the bundle having the encasing spacing and support coils means that each tube with a surrounding coil is in contact only with tubes which do not have a surrounding support coil and conversely, each tube without a surrounding support coil is in contact only with tubes which have a surrounding support coil. At the outer edges of the tube bundle some tubes will not have other tubes (or even tie rods) surrounding them on all sides but in the body of the bundle, the alternate relationship holds well.

Coils may be disposed continuously along the tubes but normally it is preferred to locate the coil supports at spaced intervals along the axial length of the tubes in the same manner as shown in FIG. 1 of application Ser. No. 10/209,126 (Publication No. 20030178187A1, corresponding to EP 1347258). Typically, the support coils would be from about 50–80 cm long at each location with the locations spaced at intervals of approximately 100–150 cm. If this arrangement is used, as is preferred, the coils at the second axial location may be provided on the tubes that did not receive coils in the first location, with this sequence alternated throughout the length of the tubes. Even though this alternating arrangement is not essential, it provides some symmetry to the shellside flow although at the disadvantage that none of the tubes can be replaced in the future. If the coils are provided only on selected tubes as shown in FIG. 1, the remaining tubes can be replaced.

Additional mixing to the shellside fluid may be provided by alternating left-handed and right-handed coils at the same axial location as well as at different axial locations.

Some of the tubes towards the outer periphery of the bundle may be replaced with tie rods such as tie rod 20 in FIG. 1. In this case, only one rod is shown for simplicity and to permit the figure to show the other features in exchanger construction preferably used with the coil-supported tubes. In an actual exchanger, tie rods would be located symmetrically around the tube bundle as necessary, to provide strength to the bundle. These tie rods preferably have a smaller diameter than the tube outer diameter and will preferably also be provided with wire coils 21 in the same manner as the tubes. The diameter of the tie rods and thickness of the encircling coil should be chosen so that the coil-encased rod supplies support to at least two adjacent tubes as shown. During construction of the exchanger, the tie rods are threaded into the first tubesheet from the shellside. They may be designed to enter partway into the second tubesheet to receive a sliding expansion connection; alternatively, they may end in a stiffener prior to reaching the second tubesheet, similar to the construction frequently used in conventional heat exchanger construction.

Figure 2:
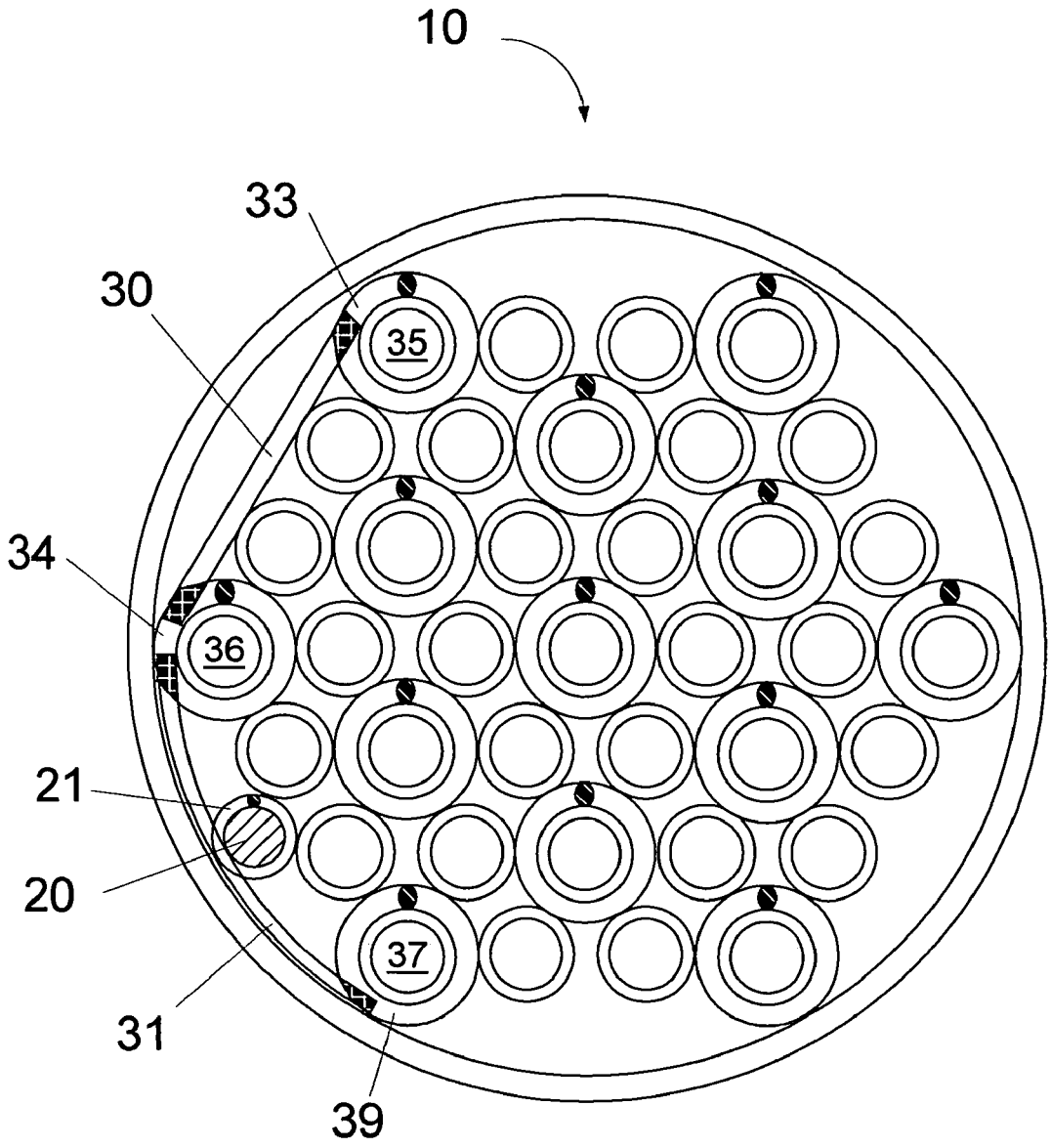
FIG. 2 is a simplified cross-section of a hypothetical heat exchanger incorporating the coil-encased tubes with two alternative arrangements for stiffening the tube bundle.

As shown in FIG. 2, (which omits repeating most reference numerals for clarity) stiffener members (30, 31) are preferably provided around the tube bundle every 100–150 cm or so to ensure that the bundle is held together adequately. These stiffener members, should be added starting adjacent the end where the tie rods are firmly attached to the tubesheet. The stiffener members may be made of curved pieces (31) (pieces cut out of pipes) or flat bars (30). One of each type is shown in a fragmentary manner in FIG. 2; in actual construction, the stiffener must surround the tube bundle in order to keep the bundle rigidly held together. In the case of the stiffener being a flat plate, as indicated by 30 in FIG. 2, the tube bundle is constrained to its hexagonal or twelve-sided shape but if a curved stiffener such as 31 is used, the tube bundle may conform to a more circular cross-section. In either case, the stiffeners may be fastened to the tubes or to tie rods or both. Flat plate stiffener 30 is welded to the coils 33, 34 wrapped around two tubes 35, 36 outermost on the bundle at two of the vertices of the hexagon defining the outside of the bundle. In a similar manner, curved stiffener 31 is welded to coils 34 and 39 on tubes 36 and 37. Optionally, it might also be welded to tie rod 20 or to coil 21 surrounding rod 20.

The depth of the stiffeners (parallel to the axis of the tubes) may typically vary between 2 to 4 cm. and, as noted above, they are typically provided at intervals of 100–150 cm along the length of the bundle. The stiffeners are welded to the tie rods or to the wires wrapped around the tubes or the tie rods.

The coils surrounding the tubes within their internal periphery serve to provide spacing and support to the tubes in the bundle. The spacing and support coils may extend all the way along the tubes from tubesheet to tubesheet with a corresponding gain in structural rigidity but in most cases, it is sufficient to have shorter coils which extend only a short distance along the tubes disposed at two or more locations along the length of the tubes, for example, coils about 20–50 cm long at intervals of about 50–150 cm, preferably 60–100 cm. For example, a coil structure may begin about 30 cm from one tubesheet and then extend approximately 20 cm. This could be followed by a gap of approximately 60-cm followed by another length of coil structure and so on. Whether coiled all the way along the tube or located intermittently, the coil should preferably make at least two complete turns around the length of the tube for adequate support and proper tube spacing.

In making up the tube bundle, the coils may be prefabricated according to specified diameter, tube pitch and coil pitch requirements. Such prefabricated coils are generally available from coil manufacturers. Individual coils are then placed around the tubes and rods and attached to them. (e.g., electrical arc welding may be used).

Rectangular sealing strips 22 are placed adjacent to the coil-encased tie rods (the tie rods of the type indicated by 20) and transversely with respect to the tubes (and the axial flow direction) in order to direct the fluid flow into the region around the tubes for effective heat transfer to take place. Larger transverse sealing strips 23 may also be placed in other regions at the periphery of the tube bundle in order to direct and maintain fluid flow in the correct, desired manner. The sealing strips may be secured in the conventional manner to the tie rods or to any other appropriate part of the tube bundle. All the sealing strips must leave adequate clearance between the end of the strip and the tubesheet(s) so as not to disrupt the flow to and from the fluid inlet and outlet which, conventionally, will be located on the side of the exchanger shell.

Longitudinal sealing strips may also be used to maintain axial fluid flow in the region directly around the tubes, that is, to prevent the fluid moving out into the regions outside the periphery of the tube bundle where heat exchange is less effective. Because the tube bundle is polygonal in outline, either hexagonal or 12-sided with larger bundles, these regions can generally be categorized as the segmental regions, six or twelve in number, between the inside of the exchanger shell and the straight peripheral limits of the tube bundle. Sealing strips of inwardly convex curved shape may be used here, as indicated by 25 in the figure. These sealing strips extend along the length of the tube bundle except at the ends of the bundle so as to permit free fluid flow in these end areas to the fluid inlet and outlet. Curved strips 25 may be secured to the bundle via tie rods and by means of the stiffeners provided around the bundle, as shown in FIG. 2. Strips of this kind may also, if of adequate section, provide support to the tubes and so help to inhibit vibration under operational conditions. To this end, the strips are preferably made in a segmental form with an integral reinforcing wire 26 on the surface which follows a helical path along and across the face of the segment in the same way that the support coils follow the tubes which they encase. These supports can be fabricated in the following manner: first, wrap a wire around, for example, a tube (e.g. such as one of the tubes in the tube bundle or another suitably sized tube which will be effective for sealing or support purposes, such as a 5 cm. diameter tube or pipe); second, secure an encircling wire to tube using resistance welding or the like, as if it were one of the tubes of the tube bundle and finally, split the tube longitudinally into several equal pieces (e.g., four). The wire may be coiled onto the strip along its complete length or, alternatively, in selected regions, appropriately those corresponding to the regions on the tubes with spacing/support wires if the tubes are not completely encased from end to end in coil. The curved segment with its attached wire can then function effectively to provide support to the adjacent tube or tubes also to maintain fluid flow closely around the tube(s) for effective heat transfer while, at the same time, providing support for the tube(s) so as to inhibit vibration. The segmental support/sealing strip can be fixed in place conventionally by the use of stiffeners provided around the tube bundle. Similar strips 27 without the spacing wire may be used as an alternative (only one indicated in FIG. 1; however, in an actual exchanger, they would be disposed evenly around the tube bundle in the six or more segmental regions between the edges of the bundle and the shell). This option is, however, less preferred than the wire-surfaced strips as it would tend to create dead zones adjacent to the tube.

A strainer of some form should normally be used at some point in the process line prior to reaching the heat exchanger. This is important in order to avoid any debris becoming trapped within the heat exchanger of the present invention either in a tube or on the shell side of the heat exchanger. If debris of a large enough size or of a large enough amount were to enter the heat exchanger of the present invention (or, in fact, any currently existing heat exchanger) fluid velocities can be reduced to the point of rendering the heat exchanger ineffective. A preferred form of strainer is described in U.S. patent application Ser. No. 10/643,377.

The tube bundles of the present type are preferably used in heat exchangers and other tube bundle devices such as condensers, nuclear reactor cores, electrical heaters or other collections of parallel cylindrical shapes with fluid flow passing over them. Preferred types of heat exchanger in which the present tube bundles may be used are those described in U.S. patent applications Ser. No. 10/209,082, corresponding to EP 1347261 (Improved Heat Exchanger with Reduced Fouling; Ser. No. 10/209,126, corresponding to EP 1347258 (Heat Exchanger Flow Through Tube Supports); Ser. No. 10/414,731, corresponding to EP 1357344 (Improved Heat Exchanger with Floating Head).

In use, an axial flow configuration is preferably used for the shell side fluid in the exchanger. In addition it is also preferable that a countercurrent flow arrangement be employed as between the two different fluids although a non-countercurrent (i.e. cocurrent) flow or a combination of cocurrent and countercurrent flow may also be implemented.

What is claimed is:

1. A tube bundle device comprising:

a plurality of parallel tubes, wherein the plurality of parallel tubes are arranged in a triangular configuration such that the tubes that are located within an interior of the plurality of parallel tubes are adjacent and spaced from six surrounding tubes;

a plurality of tube support elements, wherein a select number of tubes in the plurality of parallel tubes having the tube support elements located thereon, wherein each tube support element includes support coils of a helically wound material, wherein at least a portion of the length of each of the tubes having the tube support element located thereon is contained within an interior circumference of the support coil, wherein the surrounding tubes being in contact with an exterior circumference of the support coil, wherein the surrounding tubes with no tube support element located thereon being in contact only with support elements;

at least one tie rod extending parallel to the plurality of parallel tubes; and at least one tie rod support element located on each of the at least one tie rod, wherein the at least one tie rod comprising a helically wound material surrounding at least a portion of a length of a tie rod.

2. The tube bundle device according to claim 1, wherein the radial thickness of the coil material approximates the space between two adjacent tubes to space the tubes in the bundle apart by a distance approximately the radial thickness of the coil material.

3. The tube bundle device according to claim 1, wherein the coil has two or more complete turns around the tube which it surrounds.

4. The A tube bundle device according to claim 1, wherein the radial thickness of the coil material surrounding the rods approximates the space between each tie rod and at least one tube of the tube bundle to space the rods from the tubes apart by a distance approximately the radial thickness of the coil material.

5. The A tube bundle device according to claim 1, further comprising longitudinal sealing strips in segmental regions around the periphery of the tube bundle to maintain flow of fluid into the tube bundle away from the segmental regions along the length of the bundle.

6. The heat exchanger according to claim 5, wherein the longitudinal sealing strips comprise tubular segments having spacer/support elements comprising helically wound material surrounding at least a portion of the length of the strips, the radial thickness of the coil material surrounding the longitudinal strips approximating the space between each strip and at least one tube of the tube bundle to space the strip from the tubes apart by a distance approximately the radial thickness of the coil material.

7. A tube bundle device comprising:

a plurality of parallel tubes, wherein the plurality of parallel tubes are arranged in a triangular configuration such that the tubes that are located within an interior of the plurality of parallel tubes are adjacent and spaced from six surrounding tubes;

a plurality of tube support elements, wherein a select number of tubes in the plurality of parallel tubes having the tube support elements located thereon, wherein each tube support element includes support coils of a helically wound material, wherein at least a portion of the length of each of the tubes having the tube support element located thereon is contained within an interior circumference of the support coil, wherein the surrounding tubes being in contact with an exterior circumference of the support coil, wherein the surrounding tubes with no tube support element located thereon being in contact only with support elements; and at least one transverse sealing strip located in a segmental region around the periphery of the tube bundle to maintain flow of fluid into the tube bundle away from the segmental region along the length of the bundle, wherein each of the at least one transverse sealing strip comprising a tubular segment having a spacer/support element comprising helically wound material surrounding at least a portion of the length of the strip.

8. A shell-and-tube heat exchanger comprising:

a shell;

a tube bundle contained within the shell, wherein the tube bundle having a plurality of parallel tubes arranged in a triangular configuration such that the tubes that are located within an interior of the tube bundle are adjacent and spaced from six surrounding tubes, wherein the tubes in the tube bundle having spacer/support elements located thereon, wherein each spacer/support element comprising helically wound material in which at least a portion of the length of each of the tubes having the spacer/support element is contained within the interior circumference of a support coil, wherein the radial thickness of the coil material approximating the space between adjacent tubes to space the tubes in the bundle apart by a distance approximately the radial thickness of the coil material, wherein each tube with a spacer/support coil being in contact only with tubes which do not have a spacer/support coil and each tube without a spacer/support coil is in contact only with tubes which have a spacer/support coil; and at least one tie rod for the tube bundle, wherein each of the at least one tie rod comprises a rod having surface spacer/support element located thereon, wherein the surface spacer/support element comprising helically wound material surrounding at least a portion of the length of the tie rod, the radial thickness of the coil material surrounding the rods approximating the space between each tie rod and at least one tube of the tube bundle to space the rods from the tubes apart by a distance approximately the radial thickness of the coil material.

9. The A heat exchanger according to claim 8, wherein the coil has two or more complete turns around the tube which it surrounds.

10. The A heat exchanger according to claim 8, further comprising:

at least one transverse sealing strips located in a segmental regions between the periphery of the tube bundle and the shell to maintain flow of fluid into the tube bundle away from the segmental regions along the length of the bundle.

11. The A heat exchanger according to claim 8, further comprising:

at least one longitudinal sealing strips located in a segmental regions between the periphery of the tube bundle and the shell to maintain flow of fluid into the tube bundle away from the segmental regions along the length of the bundle.

* * * * *